US010053847B2

(12) United States Patent
Xu

(10) Patent No.: US 10,053,847 B2
(45) Date of Patent: Aug. 21, 2018

(54) KITCHEN MOUNTING PART

(71) Applicant: NINGBO AFA KITCHEN AND BATH CO., LTD., Zhejiang (CN)

(72) Inventor: Wengao Xu, Zhejiang (CN)

(73) Assignee: Ningbo AFA Kitchen and Bath Co., Ltd., Zhejiang (CN)

( * ) Notice: Subject to any disclaimer, the term of this patent is extended or adjusted under 35 U.S.C. 154(b) by 311 days.

(21) Appl. No.: 15/096,529

(22) Filed: Apr. 12, 2016

(65) Prior Publication Data

US 2017/0292255 A1 Oct. 12, 2017

(51) Int. Cl.
*E03C 1/33* (2006.01)

(52) U.S. Cl.
CPC ..... *E03C 1/335* (2013.01); *E03C 1/33* (2013.01)

(58) Field of Classification Search
CPC ..... E03C 1/33; E03C 1/335
See application file for complete search history.

(56) References Cited

U.S. PATENT DOCUMENTS 3,008,150 A * 11/1961 Lyon, Jr. ..... E03C 1/33 126/214 A
3,022,519 A * 2/1962 Lang ..... E03C 1/33 220/3.6
3,583,002 A * 6/1971 Roberts ..... E03C 1/33 4/636
4,432,106 A * 2/1984 Smith ..... E03C 1/335 4/633
5,842,240 A 12/1998 Kato et al.
5,903,936 A 5/1999 Kato
5,911,521 A 6/1999 Steinmetz et al.
6,785,918 B2 9/2004 Romo
7,523,511 B2 4/2009 Marr et al.
8,166,618 B2 5/2012 Eriksson
9,382,702 B2 * 7/2016 Wisniewski ..... F16B 21/183
2015/0074902 A1 * 3/2015 Lyons ..... E03C 1/33 4/695
2016/0319528 A1 * 11/2016 Snitil ..... E03C 1/335

FOREIGN PATENT DOCUMENTS

EP 1087066 A1 * 3/2001 ..... E03C 1/33

* cited by examiner

*Primary Examiner* — Jonathan P Masinick
(74) *Attorney, Agent, or Firm* — Raymond Sun

(57) ABSTRACT

A mounting part for an apparatus to be mounted into a cut-out of a countertop includes a rail member having a front wall with a plurality of notches, and a latch member defining an internal cross-sectional space for receiving the rail member in a manner such that the latch member is able to travel along the rail member. The latch member has a front wall with an extension having a terminal end that extends inwardly towards the rail member and which is adapted to be seated in one of the notches, with the latch member being pivotable with respect to the front wall of the rail member. A catch member is pivotably secured to the latch member, the catch member having an end edge for contacting the underside of a countertop. The mounting part also includes a pull member for pulling the latch member and the catch member upwardly.

11 Claims, 6 Drawing Sheets

KITCHEN MOUNTING PART

BACKGROUND OF THE INVENTION

1. Field of the Invention

The present invention relates to a mounting-part, such as a kitchen sink, stove top, or the like, which is to be mounted in a cut-out in a countertop.

2. Description of the Prior Art

Kitchen sinks are usually mounted in a cut-out in a countertop, with the mounting-part being bent from sheet metal (e.g., stainless steel sheet), and resting with its edge regions, which extend beyond the cut-out, on the countertop. Kitchen sinks are usually provided with numerous mounting elements below the edge region, which elements can engage the countertop and with the above-mentioned edge region merging into a sloped splash wall towards the interior of the mounting-part. At the lower end of the splash wall, the other common functional areas of the mounting-part follow, such as a sink basin, drainer, or the like.

A general problem for integrating such kitchen sinks lies in fact that the mounting elements that engage the countertop are accessible from the bottom only. The assembly is therefore awkward and must occur in a tight space. Additionally, a considerable expense in production technology is necessary in order to integrate the mounting elements at the edge of the sink.

Generally the sink is provided with mounting bars near its exterior sides extending downward, which extend into the cut-out of the countertop and at which numerous mounting elements are arranged in spaced-apart manner around the circumference of the sink. The mounting bars are either separate parts welded to the bottom of the sink, or they are directly formed by several folds of the rim of the sink. Thus, the sink is provided with a crimped rim, which first extends inwardly towards the cut-out of the countertop and then extends downwardly inside the cut-out of the countertop. Both arrangements lead to an increased production expense of the sink. Additionally, they require a relatively wide overhang of the edge region of the sink so that sufficient space remains for the mounting bars (and in particular for the fastening elements) between the sink basin and the cut-out of the countertop. These problems exist regardless of whether the mounting elements are embodied as clamping screws, or as autonomously acting bracing springs.

To address these problems, attempts have been made to mount the sink to the countertop using an adhesive. Unfortunately, such adhesive connections have not proven reliable in the long run.

Thus, there remains a need for a kitchen sink mounting mechanism that overcomes the drawbacks described hereinabove.

SUMMARY OF THE DISCLOSURE

In order to accomplish the objects of the present invention, there is provided a mounting part for an apparatus to be mounted into a cut-out of a countertop. The mounting part includes a rail member having a front wall with a plurality of notches, and a latch member defining an internal cross-sectional space for receiving the rail member in a manner such that the latch member is able to travel along the rail member. The latch member has a front wall with an extension having a terminal end that extends inwardly towards the rail member and which is adapted to be seated in one of the notches, with the latch member being pivotable with respect to the front wall of the rail member. A catch member is pivotably secured to the latch member, the catch member having an end edge for contacting the underside of a countertop. The mounting part also includes a pull member for pulling the latch member and the catch member upwardly to cause the curved terminal end to be seated into a different notch, and to cause the end edge of the catch member to contact the underside of a countertop.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1:
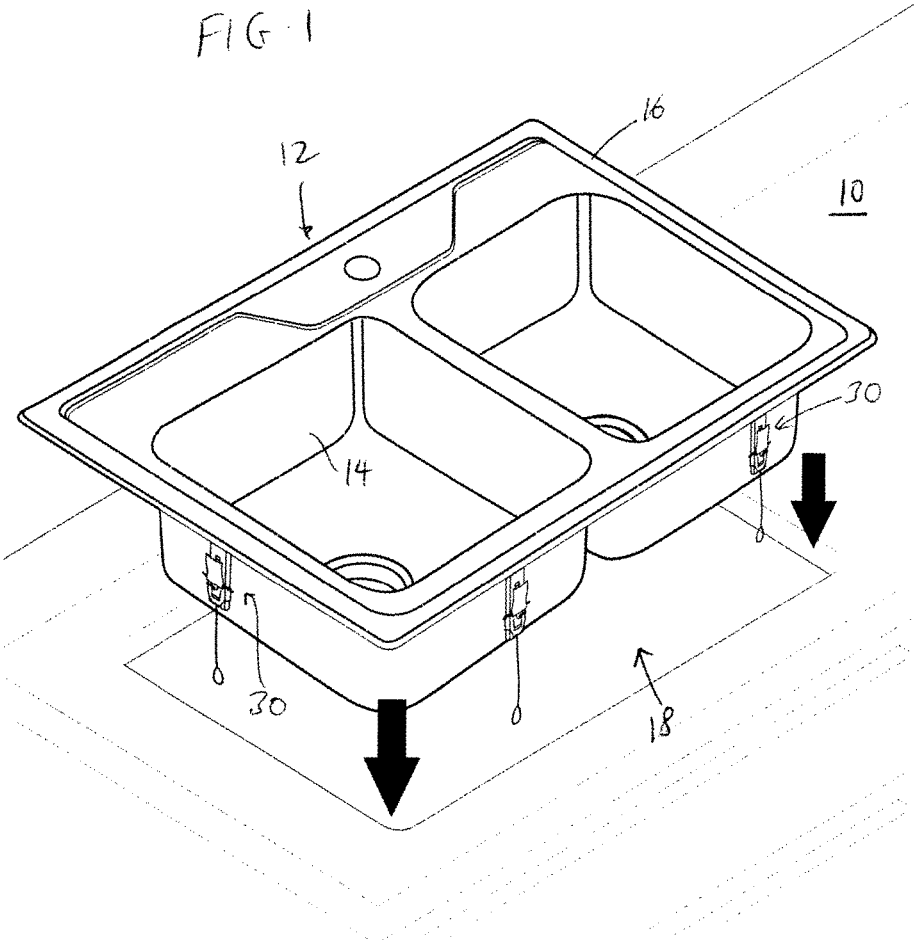
FIG. 1 is a perspective view of a kitchen sink having a plurality of mounting parts according to one embodiment of the present invention.

FIG. 1 shows a conventional countertop 10, which rests on a bottom cabinet. A sink 12 according to the present invention can be formed from a single-layer of sheet metal (e.g., stainless steel), and can be installed in a cut-out 18 of the countertop 10. The sink 12 has a basin 14 and other conventional components that are usually found in kitchen sinks, including but not limited to a faucet, a drainer, etc. The sink 12 has a horizontal, single-layered edge region 16 that extends beyond the cut-out 18, before it merges inwardly into a steeply sloped splash wall 20. The edge region 16 and the splash wall 20 have the same constant thickness as the other areas of the sink 12. The edge region 16 and the splash wall 20 also extend in the circumferential direction around the entire sink 12. The lower end of the splash wall 20 is bent horizontally inwardly and in the position of the cross-section according to FIG. 6, it acts as a frame for the basin 14 welded thereto from below. It is also possible for the basin 14 to be formed immediately into the sink 12 by way of deep-drawing such that the lower end of the splash wall 20 transitions into the basin 14 in a single piece.

The edge region 16 is slightly bent downward at its exterior edge towards the splash wall 20. This results here in a tight pressure against the countertop 10 and allows the gap developing behind the fold between the edge region 16 and the countertop 10 to be filled with silicone.

Additionally, it is essential that the splash wall 20 is sized such that it can immediately accept mounting parts 30 on its exterior side. These mounting parts 30 can be spaced apart around the circumference of the splash wall 20, and as illustrated herein, there can be six mounting parts 30.

Figure 2:
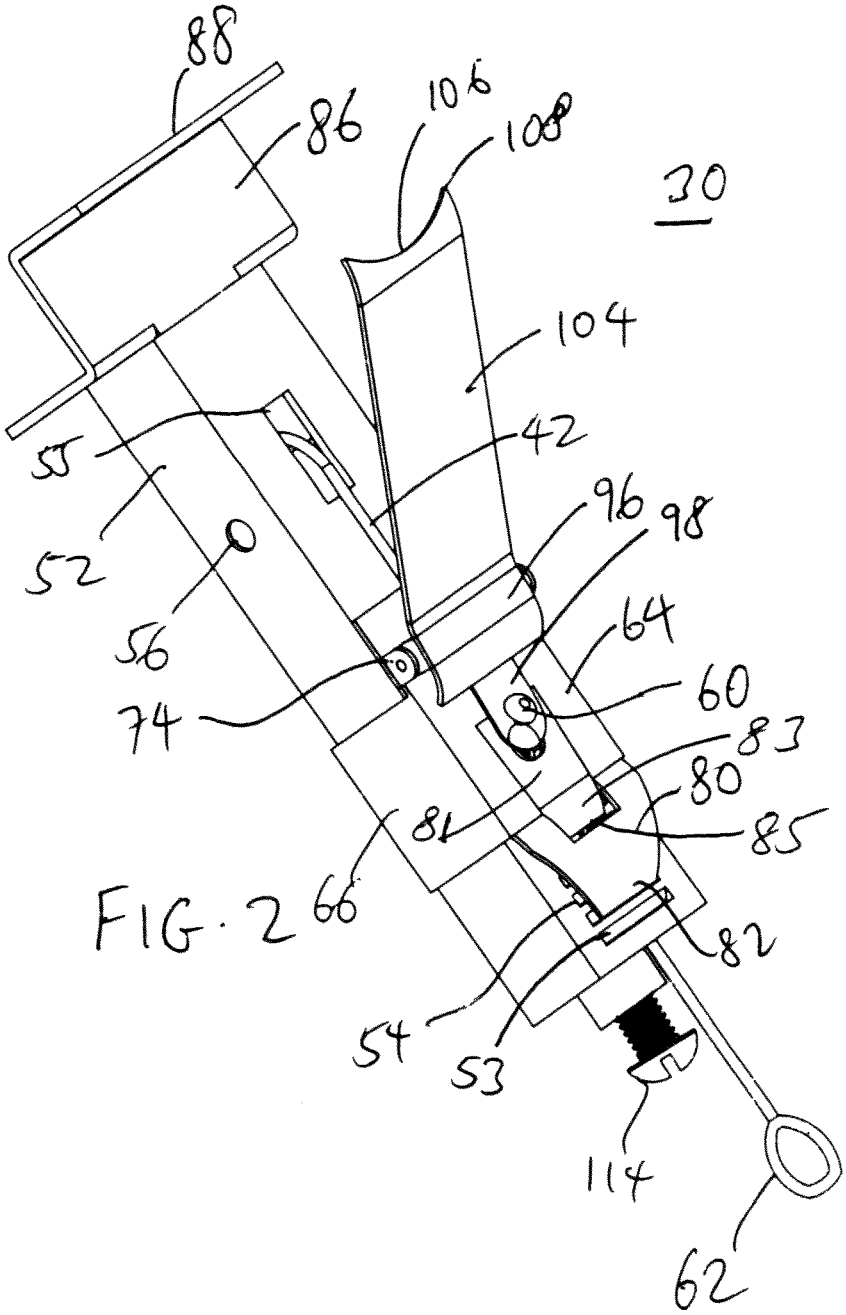
FIG. 2 is a front perspective view of the mounting part of FIG. 1.
Figure 3:
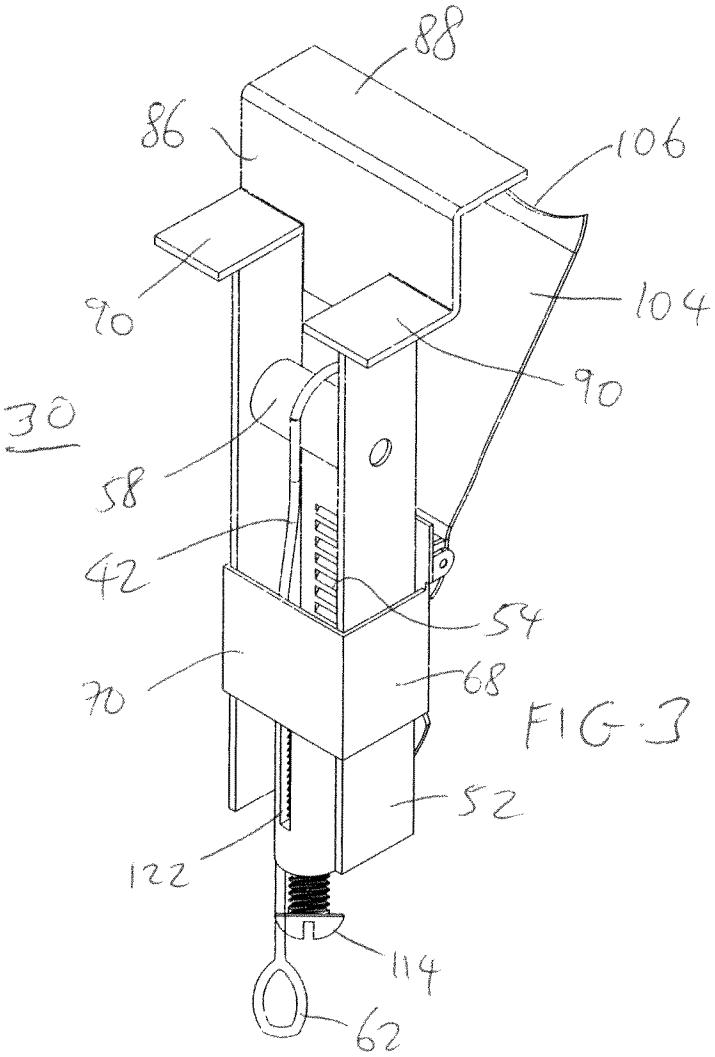
FIG. 3 is a rear perspective view of the mounting part of FIG. 1.
Figure 4:
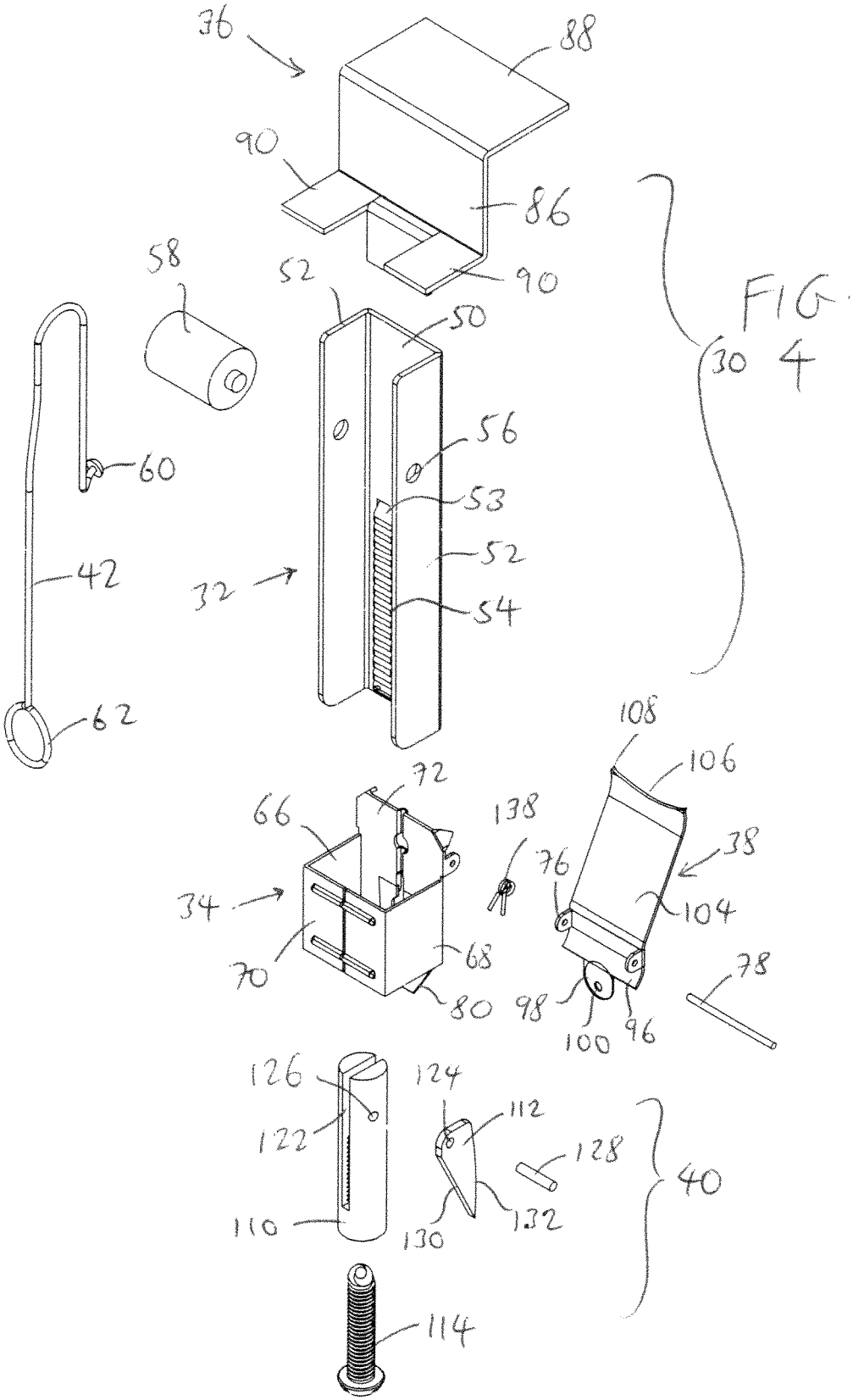
FIG. 4 is an exploded perspective view of the mounting part of FIG. 1.

Referring now to FIGS. 2-4, each mounting part 30 has a U-shaped rail member 32, a traveling latch member 34, a countertop support member 36, a catch member 38 pivotably secured to the latch member 34, a locking and release mechanism 40 positioned inside the latch member 34, and pull member 42.

The rail member 32 is generally U-shaped and elongated, having a front or base wall 50 and two side walls 52. A plurality of angled slits or notches 54 are arranged in a vertical row along the base wall 50. Referring to FIGS. 2 and 4, each slit or notch 54 has a generally rectangular opening with an angled ramp 53 extending into the opening of the slit or notch 54. A pair of aligned holes 56 are provided along the side walls 52 to receive opposite shafts of a roller bar 58 that is retained between the side walls 52 at the location of the holes 56. The pull member 42 is flexible wire or strong string member and is supported like a pulley on the bar 58, with the pull member 42 extending out of an opening 55 on the base wall 50 so that the pull member 42 extends along the outside of the base wall 50 and terminates at an enlarged head 60. The opposite end of the pull member 42 has a loop 62 through which a user can insert a finger or a tool (e.g., a screwdriver).

The latch member 34 has four walls, a longer front wall 64, two side walls 66 and 68, and a rear wall 70. The side walls 66 and 68 and the rear wall 70 are about the same dimension and function to encircle a space inside the latch member 34 that will allow the rail member 32 to be fitted loosely inside. The front wall 64 has an upper extension 72 that supports a pair of opposing ears 74 on its front surface. The catch member 38 has a pair of ears 76 that are aligned with and correspond to the ears 74, and each of the ears 74 and 76 has a hole provided therethrough for receiving a shaft 78 that is inserted through the holes of these ears 74 and 76 so as to provide a pivoting connection of the catch member 38 at the location of the ears 74. A resilient member 138 (e.g., spring) is carried on the shaft 78 and is adapted to normally bias a curved base section 96 of the catch piece 38 (described below) towards the rail member 32. The latch member 34 also has a lower extension 80 that that is curved or arched inwardly, with a terminal end 82 of the lower extension 80 adapted to be inserted into one of the plurality of slits or notches 54. In addition, the latch member 34 also has an elastic tongue 81 cut from a central portion of the front wall 64, with a curved extension 83 arched inwardly, with another terminal end 85 of the tongue 81 adapted to be inserted into one of the plurality of slits or notches 54.

The support member 36 has a an L-shaped piece that includes a vertical central section 86 having a horizontal support section 88 extending from one edge thereof, with the horizontal support section 88 adapted to be seated flat against the underside of the edge region 16. Two arm pieces 90 extend horizontally from the other edge of the vertical central section 86 and are seated on the top edges of the side walls 52. The arm pieces 90 support the underside of the lower end of the splash wall 20.

The catch member 38 has a curved base section 96 where the ears 76 are provided on opposite ends. A tongue 98 extends from the lower edge of the base section 96 and has an opening 102 that allows for the end of the pull member 42 to extend therethrough so that its enlarged head 60 is secured outside the tongue 98 to secure the tongue 98 to the end of the pull member 42. See FIG. 2. A flexible elongated grabber piece 104 extends at an angle from the upper edge of the base section 96, and has a concave upper edge 106 (i.e., extending inwardly towards the base wall 50) with two end points 108 that extend outwardly. The grabber piece 104, and in particular, the end points 104, are adapted to contact and grip the underside of the countertop 10 when the kitchen sink 12 has been installed.

Figure 5:
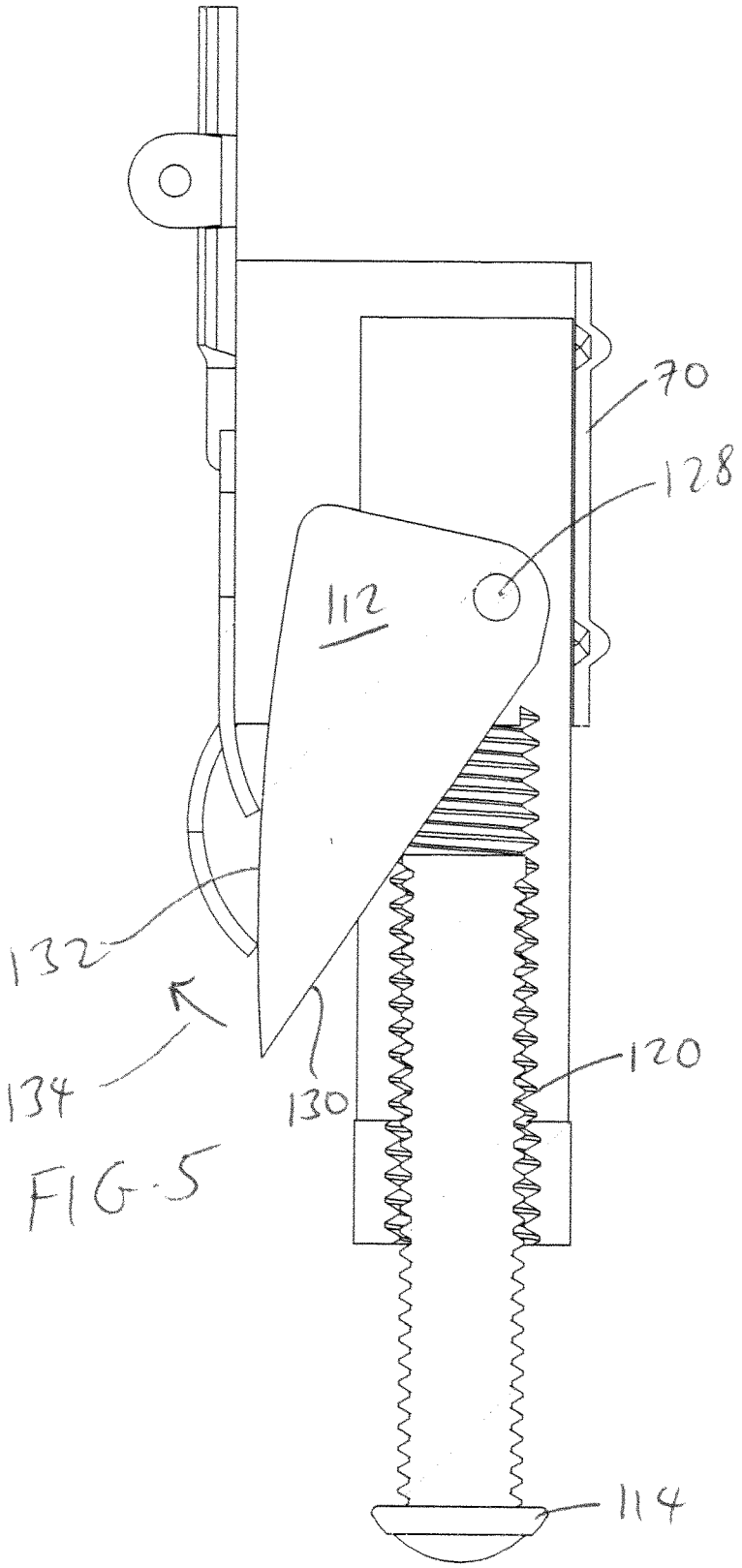
FIG. 5 is an enlarged cross-sectional view of a portion of the mounting part of FIG. 1.

The locking and release mechanism 40 includes a generally cylindrical member 110, a pusher 112 and a screw 114. Referring also to FIG. 5, the cylindrical member 110 has a circular threaded bore 120 that extends from the bottom of the cylindrical member 110 to about the center thereof, and an elongated slot 122 that extends from the top of the cylindrical member 110 to about the center thereof. The bore 120 and the slot 122 can overlap each other, as best shown in FIG. 4. The pusher 112 is a thin piece having an opening 124 at one corner that allows for the pusher 112 to be pivotally connected inside the slot 122 via an opening 126 in the cylindrical member 110 and a shaft 128. The pusher 112 also has an angled edge 130 that faces the inside of the slot 122, and a pushing edge 132 opposite the angled edge 130. The screw 114 is adapted to be threadably screwed into the threaded bore 120, and as the screw 114 advances into the bore 120, it pushes against the angled edge 130, causing the pusher 112 to be pivotably pushed outward from the slot 122 (see arrow 134 in FIG. 5). If the screw 114 is removed from the slot 122, the pusher 112 will naturally pivot back into the slot 122 under the force of gravity.

Figure 6:
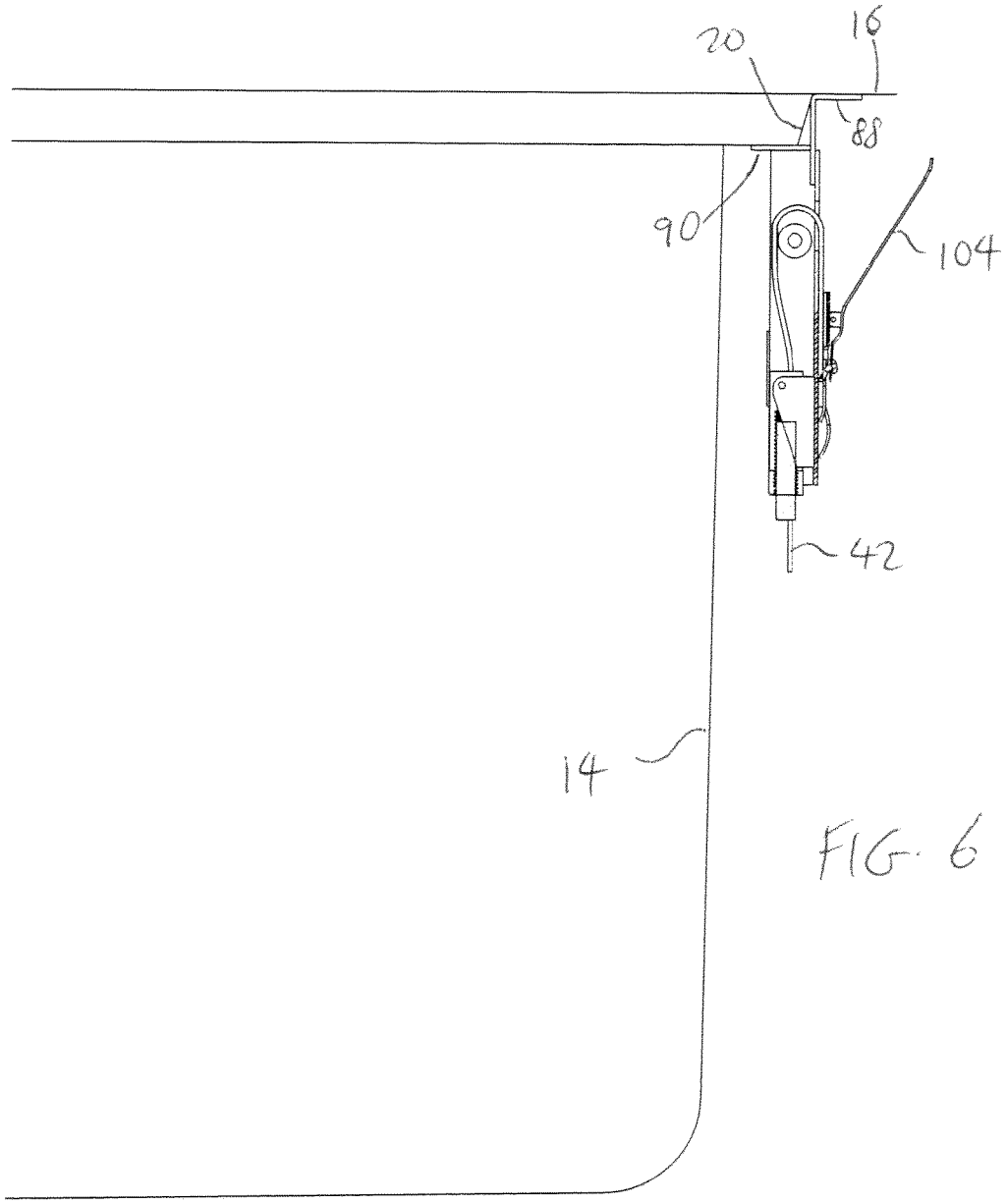
FIG. 6 is a cross-sectional side plan view showing the mounting part of FIG. 1 on a kitchen sink.

In operation, a plurality of mounting parts 30 can be spaced apart around the circumference of the splash wall 20, and as illustrated herein, there can be six mounting parts 30. As shown in FIGS. 1 and 6, the horizontal support section 88 is seated flat against the underside of the edge region 16. At the beginning of installation, the screw 114 is slightly threaded into the slot 122 so that the screw 114 does not push against the angled edge 130 of the pusher 112. Since the edge 130 is angled, the screw 114 will only start pushing against the edge 130 when it is screwed further into the 120. In this pre-installation position, the spring 138 normally biases the base section 96 of the catch piece 38 towards the rail member 32 along the pivot axis defined by the shaft 78. Since the latch member 34 is also carried and pivoted along this same pivot axis of the shaft 78, the front wall 64 of the latch member 34 is also biased (pivoted) towards the rail member 32, which in turn causes one of the terminal ends 82 and 85 of the extensions 80 and 83, respectively, to be pushed into and against a corresponding slit or notch 54.

The sink 12 is then placed through the cut-out 18 of the countertop 10, and then the user opens the cabinet door under the countertop and pulls down on the loop 62. With a strong pulling force on the loop 62, the pull member 42 will pull the latch member 34 (and the support member 36 carried thereon) upwardly until the grabber piece 104 (and in particular, the end points 104) contacts the underside of the countertop 10 so as to grip the countertop 10. Since one of the terminal ends 82 or 85 is secured in a specific slit or notch 54 prior to pulling of the loop 62, a good pulling force (e.g., using a screwdriver inserted through the loop 62) is required to force the terminal end 82 or 85 out of its slit or notch 54 and to cause it to click through the adjacent slits/notches 54 until one of the terminal ends 82 or 85 reaches the slit/notch 54 where the grabber piece 104 contacts the underside of the countertop 10. In addition, the angled ramps 53 allow the terminal end 82 or 85 to be slid into the next slit/notch 54 upon receipt of the pulling force. At that point, one terminal end 82 or 85 will be secured in the new slit/notch 54 and cannot be removed, thereby ensuring a secure grip of the grabber piece 104 against the underside of the countertop 10.

The distance between the terminal ends 82 and 85 is preferably about greater than the distance between adjacent notches 54 by a factor of 0.5. Therefore, the distance between the terminal ends 82 and 85 can be 1.5, 2.5, 3.5, (etc.) times the distance between adjacent notches 54. The reason for this arrangement is to provide for a more secure grip of the end points 104 against the underside of the counter-top. Specifically, if only one terminal end 82 or 85 was provided, it would be possible for the one terminal end to be secured inside a slit/notch 54 with a slight gap existing between the end points 104 and the underside of the countertop 10. But by providing two separate terminal ends 82 and 85 that are spaced apart by a distance that is greater than the distance of adjacent notches 54 by a factor of 0.5, it is now possible for one terminal end 82 or 85 to be secured inside a notch 54 with the other terminal end 85 or 82 outside all the notches 54, so as to provide a closer fit and a smaller gap between the end points 104 and the underside of the countertop 10. Here, the distance between adjacent notches 54 can be about 2 mm, so the distance between the terminal ends 82 and 85 can be 3 mm, 5 mm or 7 mm.

To remove or un-install the sink 12, the user will need to screw the screws 114 into the bore 120 so that the screw 114 pushes against the angled edge 130. As best shown in FIG. 5, when the screw 114 pushes against the angled edge 130, it pivots the pusher 112 outwardly, thereby pushing the terminal ends 82 and 85 away from the slits/notches 54 against the bias of the spring 138. This allows the latch members 34 to be slid downwardly to separate the end points 104 from the underside of the countertop 10.

Thus, the present invention provides a mounting part 30 that can be very easily and quickly deployed to grip the underside of the countertop 10 and secure a kitchen sink 12 to a cut-out 18 in the countertop 10. The user simply pulls the loop 62 on the pull member 42 and the installation is complete. To remove the kitchen sink 12, the user simply screws the screws 114 into the bores 120, pulls down the latch members 34, and removes the kitchen sink 12 from the cut-out 18. The mounting part 30 has a simple construction which minimizes production costs.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. A mounting part for an apparatus to be mounted into a cut-out of a countertop, comprising:

a rail member having a front wall with a plurality of notches;

a latch member defining an internal cross-sectional space for receiving the rail member in a manner such that the latch member is able to travel along the rail member, the latch member having a front wall with an extension having a terminal end that extends inwardly towards the rail member and which is adapted to be seated in one of the notches, the latch member being pivotable with respect to the front wall of the rail member;

a catch member pivotably secured to the latch member, the catch member having an end edge for contacting the underside of a countertop; and a pull member for pulling the latch member and the catch member upwardly to cause the curved terminal end to be seated into a different notch, and to cause the end edge of the catch member to contact the underside of a countertop.

2. The mounting part of claim 1, further including a countertop support member secured to an upper end of the rail member for supporting the mounting part along an edge of the apparatus.

3. The mounting part of claim 1, further including a resilient member positioned between the latch member and the catch member for normally biasing a portion of the catch member towards the latch member.

4. The mounting part of claim 3, wherein the resilient member also normally biases the terminal end of the extension into one of the plurality of notches.

5. The mounting part of claim 4, further including a locking and release mechanism positioned inside the latch member, the locking and release mechanism having a pusher that pushes against the terminal end of the extension against the bias of the resilient member to remove the terminal end from its notch and to allow the latch member to be travel freely along the rail member.

6. The mounting part of claim 5, wherein the locking and release mechanism further includes a screw that is screwed into a threaded bore to push the pusher.

7. The mounting part of claim 6, wherein the locking and release mechanism includes a cylindrical piece having an elongated slot, with the pusher pivotably coupled inside the elongated slot.

8. The mounting part of claim 1, wherein the latch member has an elastic tongue with a terminal end that is spaced apart from the terminal end of the extension by a distance.

9. The mounting part of claim 8, wherein the distance is greater than the distance between adjacent notches by a factor of 0.5.

10. The mounting part of claim 1, wherein each notch has an angled ramp positioned therein.

11. The mounting part of claim 1, wherein the pull member has a wire supported on a bar in the rail member, with the wire extending out of an opening on the front wall of the rail member and terminating at an enlarged head that is connected to the latch member.

* * * * *